US005670034A

United States Patent [19]

Lowery

[11] Patent Number: 5,670,034

[45] Date of Patent: Sep. 23, 1997

[54] RECIPROCATING ANODE ELECTROLYTIC PLATING APPARATUS AND METHOD

[75] Inventor: Kenneth J. Lowery, San Dimas, Calif.

[73] Assignee: American Plating Systems, Ontario, Calif.

[21] Appl. No.: 664,362

[22] Filed: Jun. 17, 1996

Related U.S. Application Data

[63] Continuation-in-part of Ser. No. 500,424, Jul. 11, 1995.

[51] Int. Cl.[6] ..... C25D 5/04; C25D 17/00

[52] U.S. Cl. ..... 205/143; 205/146; 204/212; 204/222; 204/224 R; 204/DIG. 7

[58] Field of Search ..... 204/212, 224 R, 204/DIG. 7, 222; 205/137, 143, 146

[56] References Cited

U.S. PATENT DOCUMENTS

| | | | |
|---|---|---|---|
| 1,793,483 | 2/1931 | Hewitt . | |
| 3,271,290 | 9/1966 | Pianowski | 204/222 |
| 3,796,646 | 3/1974 | Zambon | 204/222 |
| 3,844,542 | 10/1974 | Strecke | 204/222 |
| 3,915,832 | 10/1975 | Rackus et al. | 205/137 X |
| 4,022,678 | 5/1977 | Wojcik et al. | 204/222 X |
| 4,259,166 | 3/1981 | Whitehurst . | |
| 4,304,641 | 12/1981 | Grandia et al. . | |
| 4,359,375 | 11/1982 | Smith . | |
| 4,539,079 | 9/1985 | Okabayashi . | |
| 4,817,341 | 4/1989 | Umeda | 205/143 X |
| 4,879,007 | 11/1989 | Wong . | |
| 4,992,145 | 2/1991 | Hickey . | |
| 5,167,779 | 12/1992 | Henig | 204/222 X |
| 5,316,642 | 5/1994 | Young, Jr. et al. . | |
| 5,421,987 | 6/1995 | Tzanavaras et al. . | |
| 5,472,592 | 12/1995 | Lowery . | |
| 5,484,513 | 1/1996 | Dejneko et al. . | |
| 5,501,787 | 3/1996 | Bassous et al. . | |

*Primary Examiner*—Donald R. Valentine

*Attorney, Agent, or Firm*—Christensen O'Conner Johnson and Kindness PLLC

[57] ABSTRACT

A plating system (10) for plating a substrate such as a semiconductor wafer (116) in an electrolytic tank (12). A fixture wheel (14) is mounted within the electrolytic tank to rotate about a first axis (140). The fixture wheel receives the semiconductor wafer and supplies electrical current to the perimeter edge of the wafer. A fixture wheel drive motor (90) drives rotation of the fixture wheel about the first axis. An anode assembly (18) is mounted in the tank spaced from and facing towards the fixture wheel and received semiconductor wafer. The anode assembly carries first and second anodes (72) which are supplied with electrical current. A second motor (142) causes reciprocation of the anode assembly transversely in front of the rotating fixture wheel for improved uniformity in plating thickness and composition.

22 Claims, 11 Drawing Sheets

RECIPROCATING ANODE ELECTROLYTIC PLATING APPARATUS AND METHOD

REFERENCE TO RELATED APPLICATION

This is a continuation-in-part of prior co-pending application Ser. No. 08/500,424 filed Jul. 11, 1995, the disclosure of which is hereby incorporated by reference.

TECHNICAL FIELD OF THE INVENTION

The present invention relates to equipment and methods for plating metals onto substrates within a plating solution bath, and particularly to plating of semiconductor wafers.

BACKGROUND OF THE INVENTION

The manufacture of integrated circuit semiconductor chips requires the plating of conductive leads about the periphery of the chip. Typically, a semiconductor rod is cut into disk-like wafers having a diameter ranging from 3 to 8 inches. The formation of integrated circuit patterns on the wafer to define a plurality of circuit "chips" involves the application of a photoresist layer to one surface of the wafer. Conductive leads are then formed about each of the circuits, typically by plating gold or copper onto the wafer.

The photoresist coating is applied to the wafer during formation so as to leave a narrow band of non-coated surface exposed about the perimeter of the circuit surface of the wafer. Conventional processes for forming the leads about these circuit chips include "bump plating" methods. The wafer is immersed in an electrolyte bath, such as, for example, a cyanide gold solution for plating gold leads. The wafer is contacted on the non-coated periphery, and current is applied across the wafer and an anode, also immersed in the electrolytic bath, such as a platinum anode for gold plating. Current is applied until the desired thickness of plating builds up on the wafer.

Traditional bump plating methods do not provide for uniformity in the plating thickness over the exposed surfaces of the wafer, however. The thickness of the plated leads may vary up to 200% across the width of the wafer. This results in a large rate of unacceptable chips being produced from each wafer.

One conventional method of improving uniformity of plating thickness across a wafer is the fountain plating technique. This method entails flowing a stream of electrolyte solution through an array of apertures formed in an anode plate, resulting in jets of solution being dispelled from the anode plate towards the semiconductor wafer. Examples of such fountain plating methods are disclosed in U.S. Pat. No. 4,304,641 to Grandia et al. and U.S. Pat. No. 5,421,987 to Tzanavaras et al. Several drawbacks are posed by such conventional methods. If the semiconductor wafer and anode jet assembly are oriented in the vertical disposition, differing portions of the wafer are exposed to differing total volumetric flow rates of electrolyte. Further, most commercial versions of fountain platers position the wafer and anode plate in a horizontal position, which can lead to the entrapment of gas bubbles within the plating layer.

Another method of improving plating thickness, also developed by the present inventor and assigned to American Plating Systems, is disclosed in U.S. Pat. No. 5,472,592 to Lowery, the disclosure of which is hereby incorporated by reference. This method entails rotation of a semiconductor wafer on a rotating fixture wheel about a first axis while revolving the rotating fixture wheel around anodes arranged about a second axis which is oriented perpendicular to the first axis. This method produces a significant improvement in uniformity of plating thickness across the width of the wafer.

However, a limitation of both the rotary/revolving system of U.S. Pat. No. 5,472,592 and the fountain plating systems arises due to the manner in which electrical current is supplied to the semiconductor wafers. The fixture in which the semiconductor wafer is mounted in each case includes electrical contacts placed around the perimeter of the semiconductor wafer. This results in a greater buildup of plating around the perimeter edge portion of the wafer relative to the center of the wafer, due to the increased distance of the center portion from the source of electrical current supply and resultant decrease in electrical current density.

Another limitation of conventional plating systems is experienced when plating on alloy, such as a tin/lead eutectic. The alloy composition also tends to vary across the width of the wafer to a certain extent, due to variations in plating current density. If the composition falls out of tolerance, a significant portion of circuits are necessarily rejected and reworked.

There thus exists a need to provide for uniform plating thickness and composition across the width of a semiconductor wafer or other substrate while accounting for differences in the distance of specific surface area locations from the source of electrical supply.

SUMMARY OF THE INVENTION

The present invention thus provides a method for plating integrated circuit chips and other articles with a highly uniform plating thickness. The apparatus and method are useful for plating not only circuit chips, but ceramic packages, thick or thin substrates, dimensional printed circuit boards, parts with "blind" recesses, and parts with through holes. Various metals, including gold, nickel, silver, tin, lead, palladium, and copper can be plated onto substrates using the method.

The present invention discloses a plating system and method for plating a substrate in an electrolytic bath. The system includes a substrate fixture in which the substrate is mounted and which supplies electrical current to the substrate. The system further includes an anode assembly on which at least one anode is mounted and supplied with electrical current. A first motor is used to rotate one of either the substrate fixture or the anode assembly about a first axis. A second motor causes the other of the substrate fixture or anode assembly to translate transversely to the axis of rotation. The controller enables controlling the speed of rotation relative to the speed of translation to increase uniformity of plating deposited on the substrate.

In the preferred embodiment of the invention, the substrate fixture is a fixture wheel which is rotated about a first axis. The anode assembly is mounted spaced from and facing the substrate on the fixture wheel. The anode assembly is translated from side to side in front of the fixture wheel and the substrate. The speed of reciprocal translation of the anode assembly and speed of rotation of the substrate are controlled such that portions of the substrate which are further from the source of electrical supply receive more exposure to the anode than do portions of the substrate which are closer to the source of electrical current supply.

In a still further aspect of the present invention, the anode assembly includes first and second anodes which are spaced apart. Each anode is shrouded with a shield which reduces and focuses the area of the anode facing the substrate. A substrate, which may be a semiconductor wafer, is centrally mounted on the fixture wheel, with plating current being supplied to the perimeter edges of the semiconductor wafer. As the anodes are reciprocated relative to the rotating semiconductor wafer, the center portion of the semiconductor wafer receives greater exposure to the focused anodes.

The method and system of the present invention result in the deposition of plating having a highly uniform thickness and composition. In particular, for the plating of integrated circuit chips on a wafer, the percentage of acceptably plated integrated circuits on each wafer increases significantly due to the plating thickness being maintained with a less than ±0%, and typically less than ±5% deviation, over the width of the wafer.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
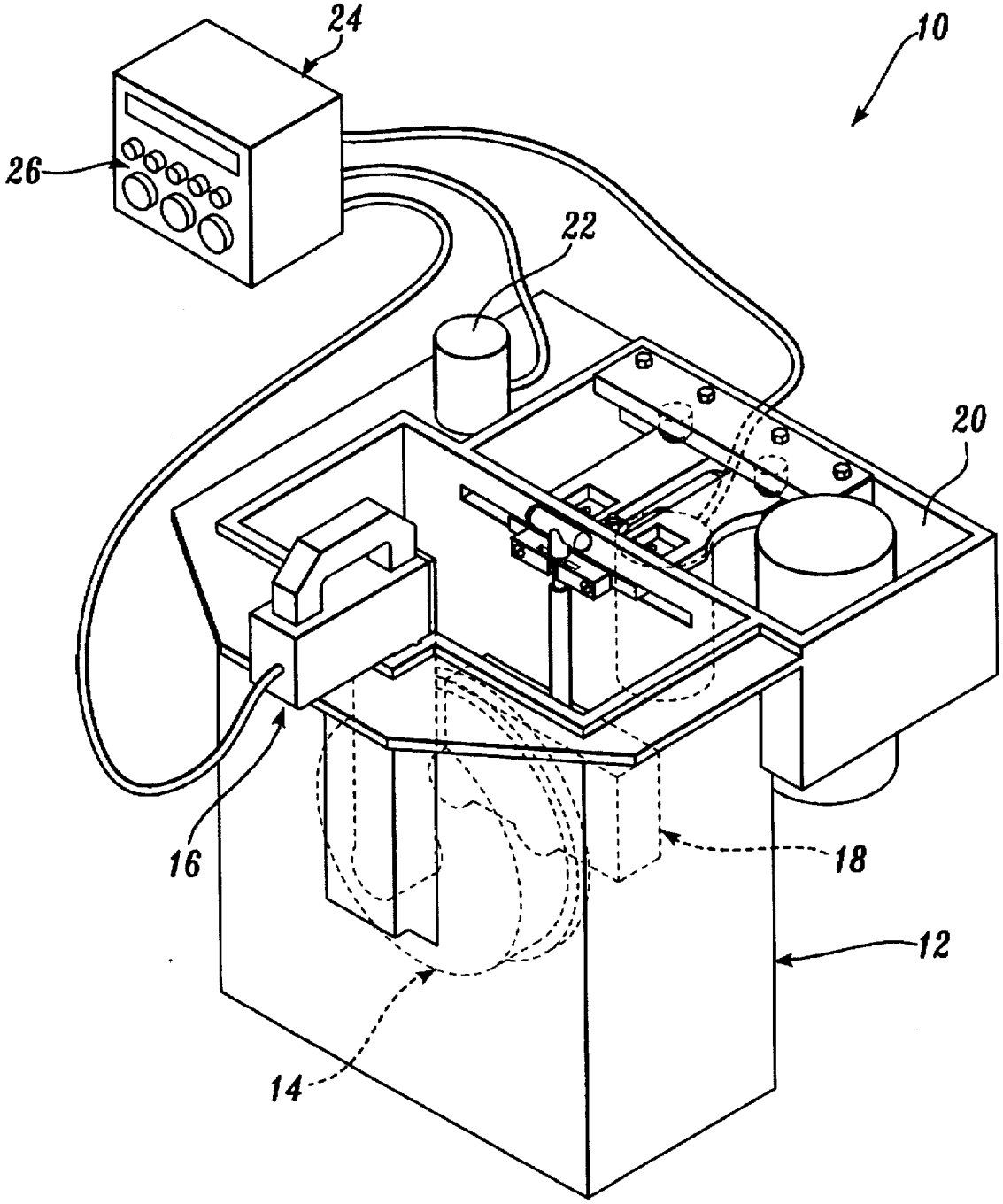
FIG. 1 provides a pictorial view of a plating system constructed in accordance with the present invention, with the fixture wheel, anode assembly and anode motor indicated in broken line.

Referring to FIG. 1, a preferred embodiment of a plating system 10 constructed in accordance with the present invention is illustrated. The plating system 10 includes a tank 12 for containing an electrolytic solution. The tank 12 receives a fixture wheel 14 which receives a substrate to be plated, such as a semiconductor wafer. The fixture wheel 14 is rotatably mounted on the end of a fixture arm 16 so that the substrate to be plated faces inwardly into the interior of the tank. The plating system 10 further includes an anode assembly 18 which is mounted within the tank to face inwardly towards the substrate carried on the fixture wheel 14. The anode assembly 16 reciprocates from side to side in front of the fixture wheel 14 during plating. The electrolyte solution is circulated through the tank 12 by a pump 22 mounted in an equipment well 20. Rotation of the fixture wheel 14, reciprocation of the anode assembly 18, and operation of the pump 22 are controlled by a controller 24 including a central processing unit which is selectively controlled by a user interface 26.

Figure 2:
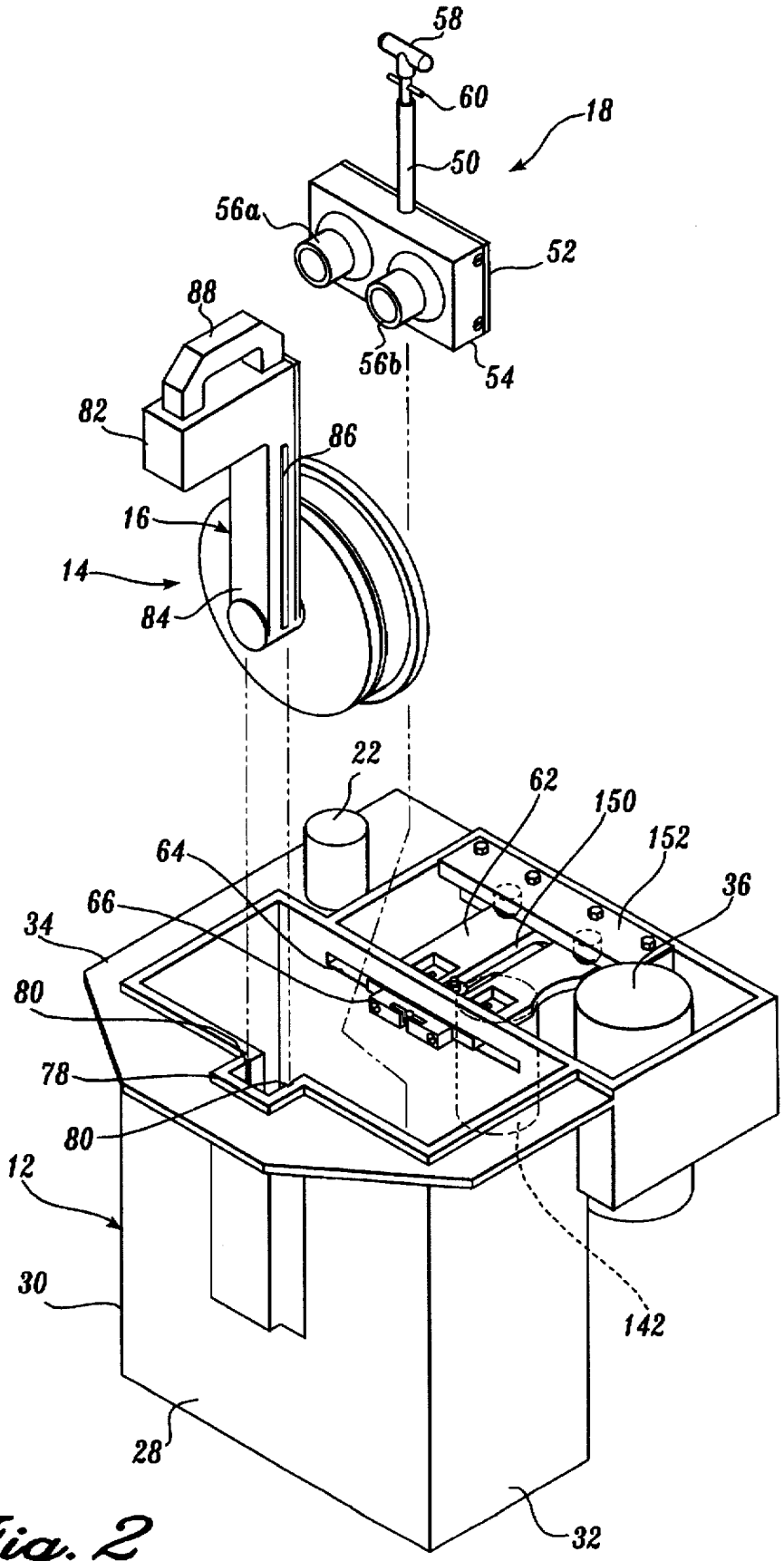
FIG. 2 provides a pictorial view of the plating system of FIG. 1, with the fixture wheel, mounting arm and anode assembly exploded from the plating tank.

Attention is directed to FIGS. 2–6 to describe the construction and operation of the tank 12. Referring first to FIG. 2, the tank 12 includes a forward side 28, a rear side 30, a right side 32 and a left side 34. The tank 12 and structural components therein are constructed from a metal or polymeric material that is resistant to the plating solutions being utilized, such as polypropylene, Teflon™ or stainless steel.

Figure 4:
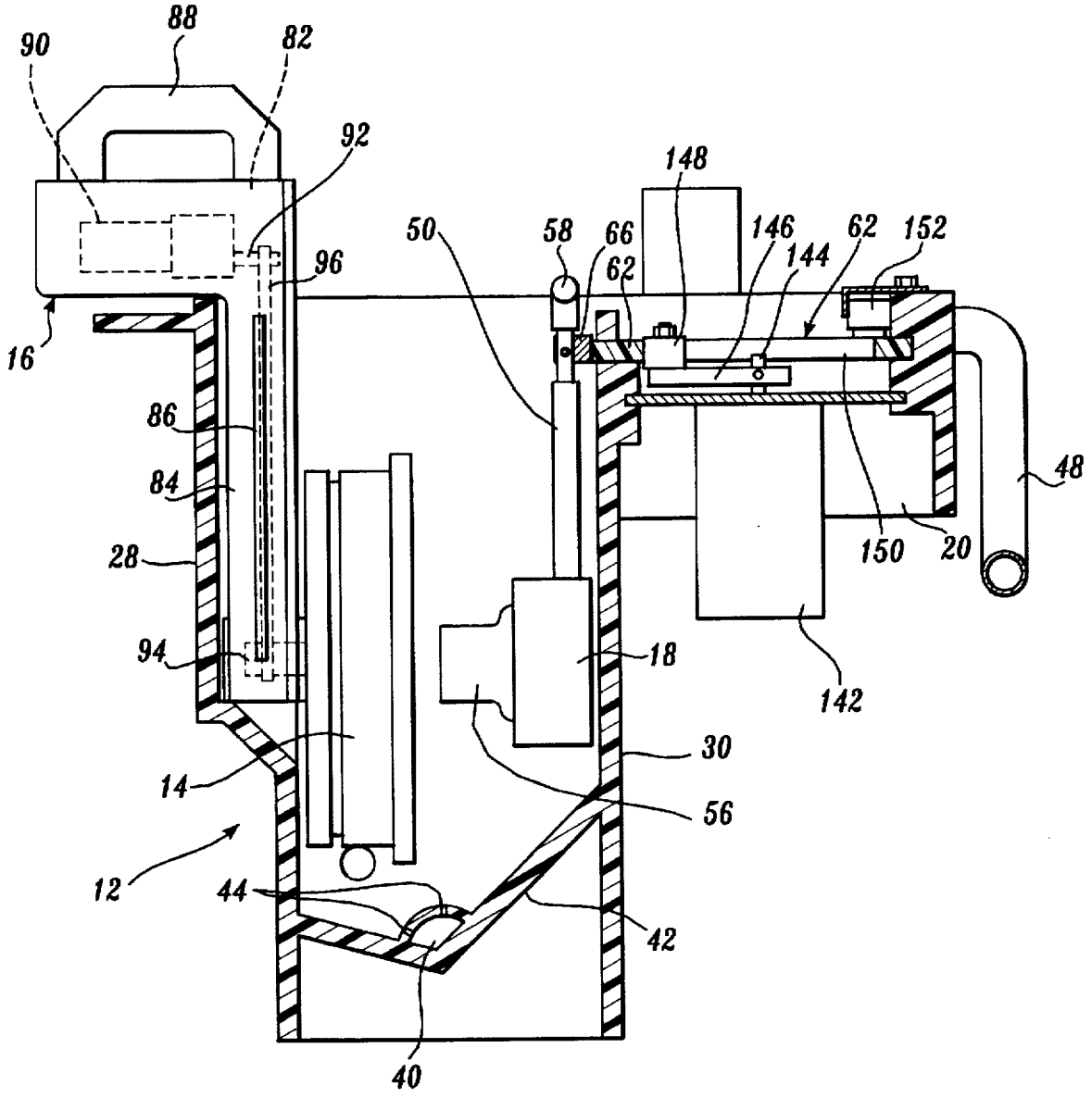
FIG. 4 provides a cross sectional view of the plating tank of the plating system of FIG. 1 taken substantially along line 4—4 of FIG. 6, with the motor and drive chain of the fixture wheel mounting arm shown in broken line.
Figure 6:
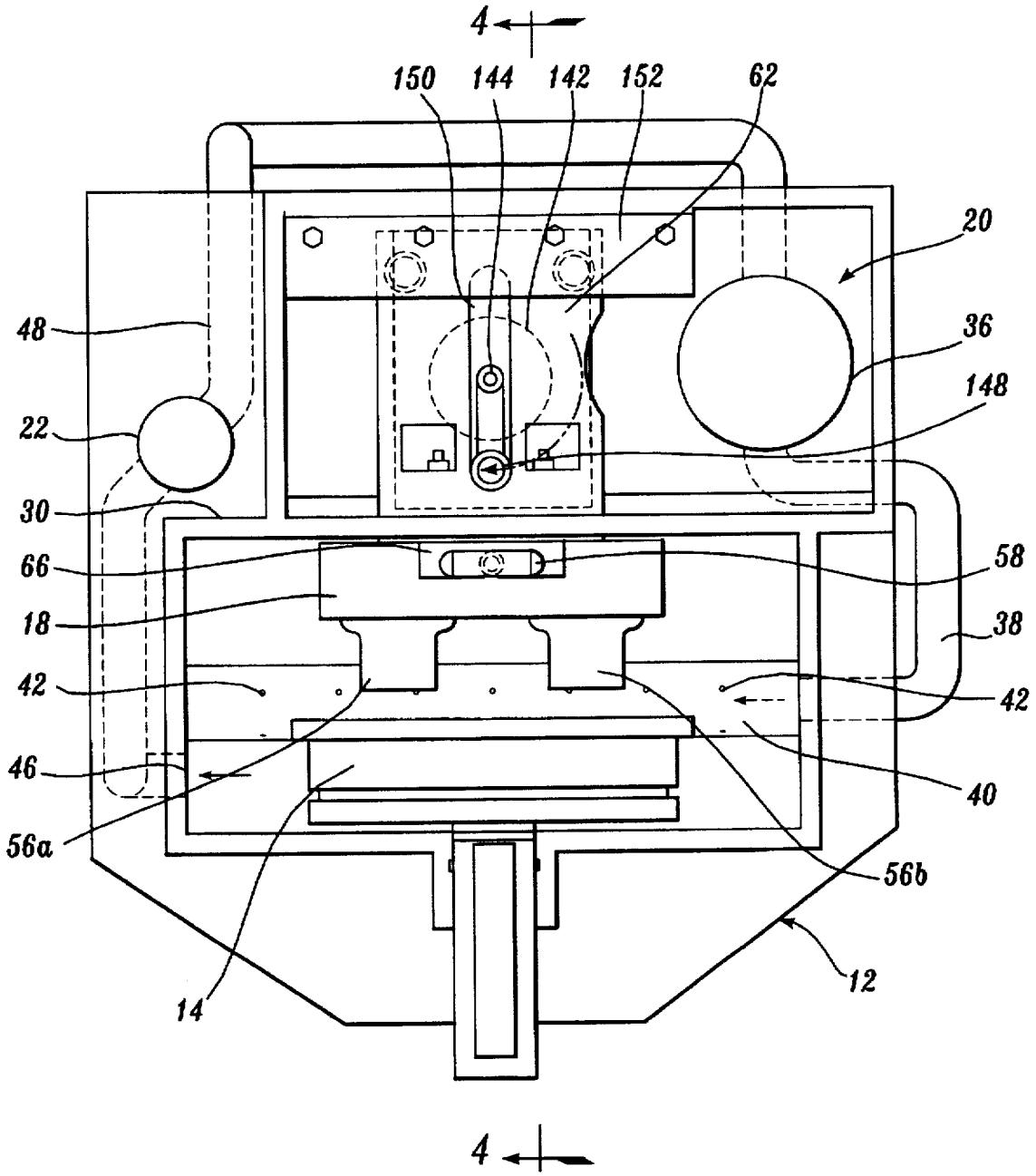
FIG. 6 provides a top plan view of the plating system of FIG. 1, with the anode assembly shown in an intermediate position.

Referring to FIG. 6, the equipment well 20 is mounted on the rear side 30 of the tank 12. A filter 36 is mounted within the equipment well 20. An electrolyte solution flows through the filter 36 into an inlet line 38 (FIG. 6) to a distribution passage 40 (FIG. 4) formed crosswise along the lowermost portion of a contoured bottom 42 of the tank 12. As shown in FIGS. 4 and 6, the distribution passage 40 includes a series of apertures 44 formed along its length which permit electrolyte solution to be sparged upwardly into the tank 12. The apertures 44 are placed to cause solution to flow upwardly between the rearward face of the fixture wheel 14 and the forward face of the anode assembly 18. Electrolyte solution is then withdrawn through an outlet 46. The outlet 46 supplies a return line 48 which passes through the pump 22 for return of electrolyte back to the filter 36. The recycling and sparging of electrolyte through the plating tank 12 ensures that the semiconductor wafer is exposed to a uniform composition of electrolyte and avoids local deficiencies.

Figure 3:
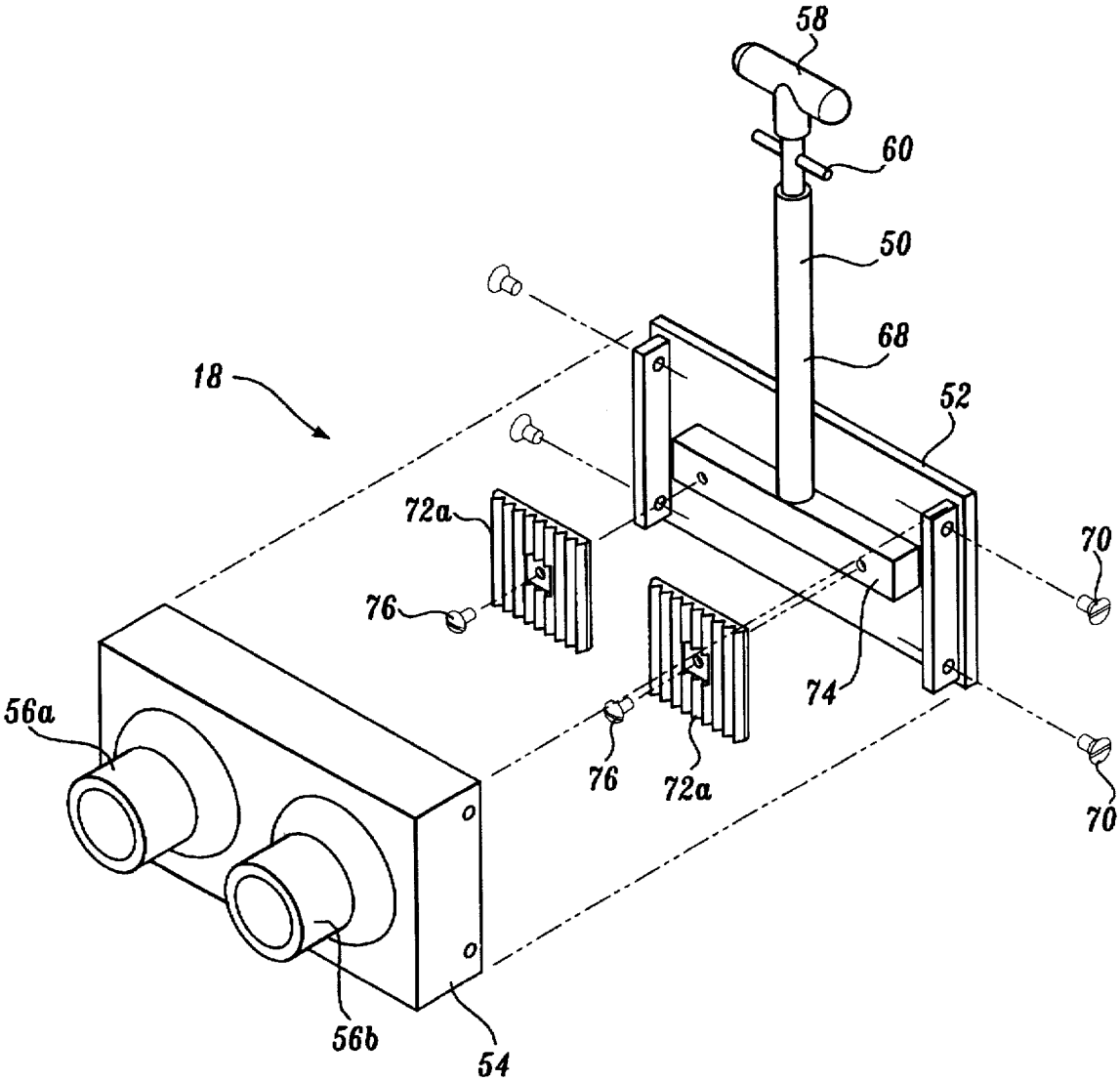
FIG. 3 provides an exploded pictorial view of the anode assembly of the system of FIG. 1.

Referring now to FIGS. 2 and 3, construction and mounting of the anode assembly 18 will be described. The anode assembly 18 includes a support rod 50, a base plate 52, a housing 54, and left and right anode shields 56A and 56B. A T-handle 58 is mounted on the uppermost end of the support rod 50. A transverse mounting pin 60 is mounted crosswise through the upper end of the mounting shaft 50 below the T-handle 58.

The plating system 10 includes an anode cam plate 62 (FIG. 2) mounted within the upper portion of the equipment well 20, the function of which will be described subsequently. A forwardmost edge of the anode mounting plate 62 extends forwardly through a horizontal slot 64 formed below the upper edge of the back wall 30 of the tank 12. An anode assembly mounting block 66 is bolted or otherwise secured to the forwardmost edge of the anode cam plate 62. The anode mounting block 66 includes a vertical slot formed into the forward face of the mounting block 66 which receives the anode support rod 50. The anode mounting block 66 further includes a transverse slot formed in the upper surface of the block, which intersects the vertical slot, and which receives the protruding ends of the transverse pin 60 of the anode support rod 50.

The entire anode assembly 18 can thus be installed within the tank 12 by inserting the support rod 50 and transverse pin 60 into the anode mounting block 66. A spring-loaded ball plunger (not shown) carried in the mounting block 66 engages with a detent (not shown) formed in the rear side of the support rod 50 to secure the anode assembly 18 in place. This permits ready removal and replacement of the anode assembly 18 within the tank 12.

The length of the support rod 50 is covered with a non-conductive, corrosion resistant polymeric jacket 68. Referring to FIG. 3, the housing 54 of the anode assembly 18 is secured by fasteners 70 to the base plate 52, and can be readily removed to expose the internally received left and right anodes 72A and 72B. The base plate 52 carries a transverse bar 74 which is secured to the bottom end of the support rod 50 and covered by a non-conductive, corrosion resistant polymeric jacket. The left and right anodes 72A and 72B are secured by fasteners 76 to opposite ends of the bar 74. The anodes 72A and 72B are spaced apart on a horizontal axis. The anode mounting block 66, support rod 50, bar 74, and fasteners 76 are all electrically conductive, permitting the supply of electrical current to the anodes 72. The remainder of the anode housing 54 and base plate 52 are preferably constructed from nonconductive materials.

The left and right anode shields 56A and 56B are secured to the forward face of the anode housing 54. Each anode shield 56 is oriented directly in front of and centrally with regard to its corresponding anode 72. Each anode shield 56 is formed as a tubular member having an internal open area which is smaller than the total surface area of the anode 72.

The effect of the anode shields 56A and 56B thus is to "focus" the exposure of the anode 72, i.e., the plating current density, to the semiconductor wafer carried on the fixture wheel 14. In one suitable embodiment of the invention, which is disclosed solely by way of example and which is not intended to limit the invention, the anodes are each formed as 2¼ inch by 2¼ inch squares. Each anode is shielded by a shield 56 having an internal diameter of 1.0 inch. The length of the shields 56 and spacing of the forward tips of the shields relative to the fixture wheel 14 is such that the anode's focused center path diverges to approximately 1-⅜th inch at the surface of the wafer carried on the fixture wheel 14. Beyond the focused center, the current density is more diffuse and less effective. Without the shields 56, the entire semiconductor wafer carried by the fixture wheel 14 would be exposed at any given time to diffuse current from the anode, leading to a loss of ability to control exposure of specified areas of the semiconductor wafer to the anode. Focusing the anodes to affect an area of the semiconductor wafer, which is smaller than the total area, enables area-specific control of plating of the semiconductor wafer.

Attention is now directed to FIGS. 2 and 4 to describe construction and mounting of the fixture arm 16. The front side 28 of the tank 12 includes an elongate, depending channel 78. An elongate groove 80 is formed in each of the left and right sides of this U-shaped channel. The fixture arm 16 includes a motor housing section 82 and a support section 84 depending downwardly therefrom. An elongate rib 86 is formed on each of the left and right sides of the support section 84. The ribs 86 engage with the grooves 80 when the support section 84 of the fixture arm 16 is slid downwardly into the channel 78. Engagement of the grooves 80 and ribs 86 securely positions the fixture arm 16 in the forward and rearward directions. When fully inserted, the motor housing section 82 of the fixture arm 16 rests atop of the tank 12, and the bottom end of the support section 84 rests within a ledge formed in the bottom of the channel 78, as shown in FIG. 4. In this position, the axis of the fixture wheel 14 is centered on the centerline of the anode assembly 16. A handle 88 is provided atop of the motor housing section 82 to allow ready placement and removal of the fixture arm 16 and fixture wheel 14 carried thereon from the tank 12.

Referring to FIG. 4, a fixture wheel drive motor 90 is housed within the motor housing section 82 of the fixture arm 16, and is controlled by the controller 24 (FIG. 1). A drive shaft 92 projects forwardly from the motor 90 above the support section 84 of the fixture arm 16. A fixture wheel shaft 94 is journaled within the lowermost end of the support section 84, and projects rearwardly towards the interior of the tank 12 to receive the fixture wheel 14. A drive chain 96 is journaled about sprockets (not shown) mounted on the motor drive shaft 92 and the fixture wheel shaft 94. Rotation of the motor 90 thereby drives rotation of the fixture wheel shaft 94. While the use of a drive chain 96 and sprockets have been described, it will be readily apparent to those of ordinary skill in the art that other force transmission mechanisms such as a cable and pulleys can be utilized.

Figure 5:
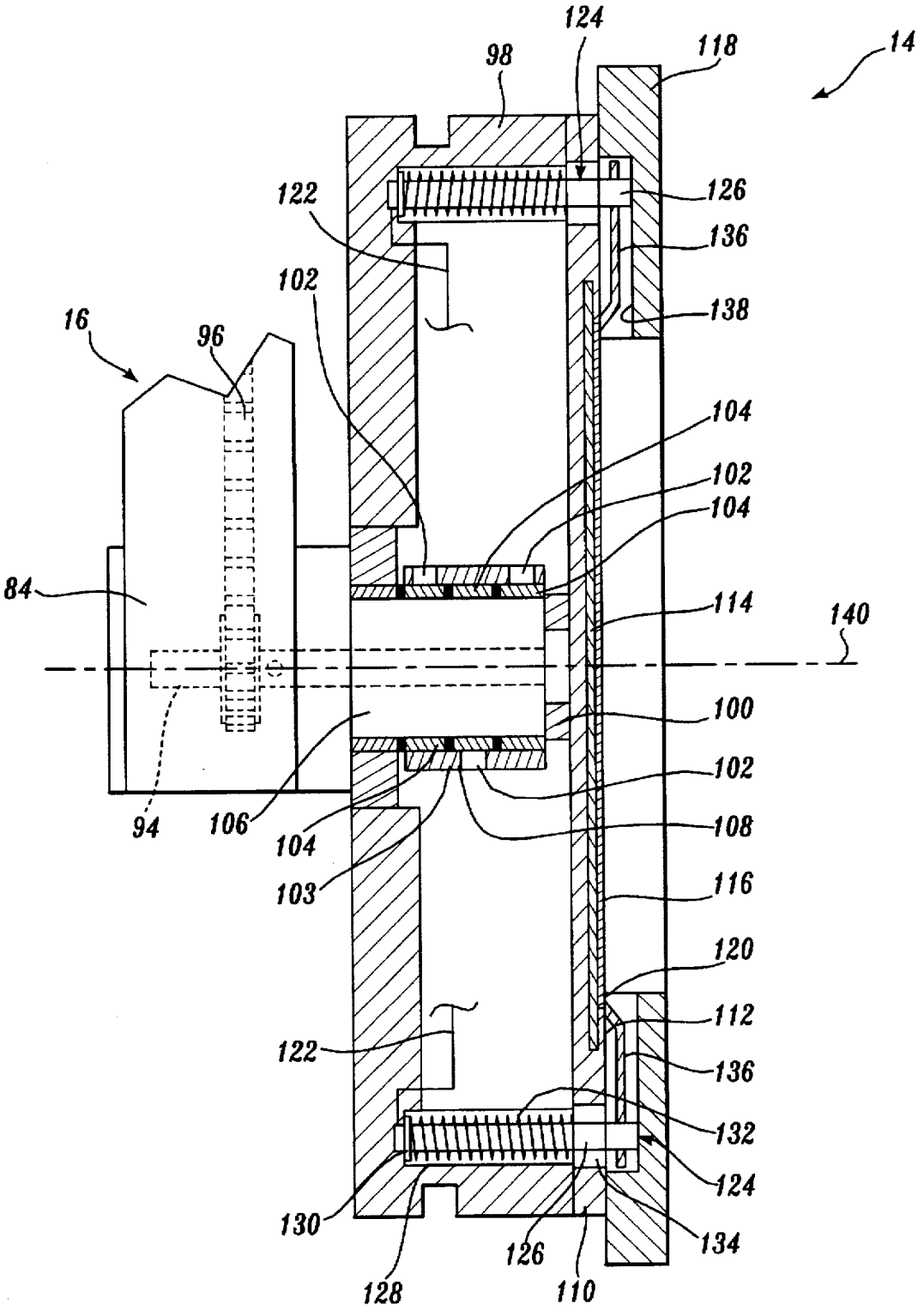
FIG. 5 provides a side cross sectional view of the fixture wheel of the plating system of FIG. 1, taken along a line extending radially from a first outer electrical contact to the center of the fixture wheel, and then extending radially through a second outer electrical contact.

Construction of the fixture wheel 14 is illustrated in FIG. 5. An annular mounting boss 106 protrudes from the bottom of the support section 84 of the fixture arm 16. The fixture wheel drive shaft 94 projects outwardly through the mounting boss 106. The fixture wheel 14 includes a fixture wheel base 98 that is journaled on the mounting boss 106 and secured by a hub 100 to the projecting end of the fixture wheel drive shaft 94. The fixture wheel 98 rotates with the hub 100 and drive shaft 94. Electrical brush contacts (not shown) are mounted within passages 102 formed within an interior annular wall 103 of the fixture wheel base 98. The spring-loaded brash contacts ride on stationary annular electrical contacts 104 which are carried on the stationary mounting boss which surrounds the drive shaft 92. The annular electrical contacts 104 are separated by insulating seals 108. The electrical contacts 104 receive power via leads threaded through the interior of the fixture arm 16.

The fixture wheel base 98 is assembled with a disc-like cover plate 110, as shown in FIG. 5. The cover plate 110 is secured to the fixture wheel base 98 by a plurality of screws (not shown) inserted through apertures formed radially about the periphery of the cover plate. A large circular recess 112 is formed in the front face of the cover plate 110, covering all but an outer peripheral portion of the cover plate 110. This recess 112 is undercut along its circular edge. This undercut recess 112 is filled with an elastomeric gasket 114, such as a silicone elastomer gasket, for purposes of cushioning and sealing the back surface of a received semiconductor wafer 116.

An annular fixture ring assembly 118 is mounted to and spring biased against the outer face of the cover plate 110. The annular fixture ring assembly 118 includes an annular recess 120 formed in the side facing the cover plate 110 about the ring's inner circumference. This recess 120 is dimensioned to receive the edge of a semi-conductor wafer 116. The semi-conductor wafer 116 is placed within the recess 120 of the assembled fixture ring assembly 118, and can then be sandwiched between the fixture ring assembly 118 and the elastomeric gasket 114 of the cover plate 110.

Channels formed within the fixture wheel base 98 receive electrical leads 122, which are connected to the brash contacts (not shown) that ride on the stationary electrical contacts 104 surrounding the drive shaft of the fixture wheel. The electrical leads 122 are in turn connected to corresponding spring-loaded electrical contact pin assemblies 124, which also serve to secure the fixture ring 118 to the cover plate 110. Each spring-pin assembly 124 includes a central pin 126 that is oriented axially within a longitudinal passage 128 formed through the cover plate 110 and into the fixture wheel base 98. A stop 130 is secured to the innermost end of each pin 126. The pin 126 then receives a coil spring 132. The spring 132 and pin 126 are retained within the passage 128 by a threaded plug 134 secured into a threaded outer portion of the passage 128 within the base plate 110. The projecting end of the pin 126 extends into a passage formed into fixture ring assembly 118. An electrical contact pin 136 is secured to the end of the pin 126 and passes through a channel 138 formed in the fixture ring assembly 118. The contact pins 136 contact the edge of the received semiconductor wafer to complete delivery of electrical current to the wafer.

The spring-pin assemblies 124 act to bias the fixture ring assembly 118 toward the fixture wheel base 98. Preferably three spring-pin assemblies 124 are utilized, and are oriented at 120° radial positions about the perimeter of the fixture ring assembly 118.

The spring force of the springs 132 utilizing the spring-pin assemblies 124 is selected so that the fixture ring assembly 118 can be forcibly retracted from the cover plate 110 and fixture wheel base 98, creating a space of approximately ½" therebetween to allow removal and insertion of semi-conductor wafers. The spring force is further selected at a predetermined value so that when this force is relieved from the fixture ring assembly 118, the fixture ring assembly 118 returns inwardly towards the base plate 110, securely gripping the semi-conductor wafer therebetween without damaging the semi-conductor wafer. A seal is maintained between the semiconductor wafer and the underlying elastomeric gasket to prevent leakage of plating solution to the back face of the semi-conductor wafer. The front face of the wafer is exposed through the center opening 120 of the fixture ring assembly 118.

Attention is now directed to FIG. 4 to describe the positioning of the fixture wheel 14 relative to the anode assembly 18. The fixture wheel 14 rotates on an axis 140 (FIG. 5), which is the longitudinal axis of the fixture wheel drive shaft 94. In the embodiment illustrated, the semiconductor wafer 116 is mounted axially on this axis of rotation 140. As shown in FIG. 4, the anode assembly 18 is mounted at an elevation such that the anodes 72 and anode shields 56 are aligned at the same vertical elevation as the fixture wheel 14 and wafer 116. Thus the center line of each anode 72 and anode shield 56 is aligned in elevation with the axis 140 of the fixture wheel 14.

Referring to FIG. 6, the anode assembly 18 reciprocates from side to side in front of the fixture wheel 14. In particular, the anode assembly 18 reciprocates along a line which is oriented perpendicular to the axis 140 of rotation of the fixture wheel 14.

The method of translating the anode assembly 18 is best understood with reference to FIGS. 2, 4 and 6. A motor 142 is mounted behind the tank 12 and drives rotation of an upwardly extending drive shaft 144 (FIGS. 4 and 6). An elongate crank 146 is fixed at one end to the shaft 144 and extends radially outward therefrom. A cylindrical cam 148 is carried on the opposite end of the crank 146. The crank 146 rotates with the drive shaft 144, and causes the cam 148 to scribe a circular path.

The cam 148 rides within a cam slot 150 formed in an overlying anode cam plate 62. The anode cam plate 62 is positioned within the upper portion of the equipment well 20, behind the tank 12. A rear end of the cam plate 62 is slidably received within a track assembly 152 assembled to the inside of the rearward wall of the equipment well 20. The opposite, forward end of the cam plate 62 projects into a slot 64 formed transversely through the upper end of the rear wall 30 of the tank 12. The cam plate 62 is able to slide leftward and rightward within the track assembly 152 and slot 64.

The cam slot 150 extends in the forward to rearward direction within the cam plate 62. The cam 148, which is revolving around the drive shaft 144, rides within the cam slot 150, causing the cam plate 62 to reciprocate first leftward, and then rightward, and then back leftward as the drive shaft 144 rotates. As noted previously, the anode mounting block 166, which supports the anode assembly 18, is mounted on the forward end of the anode cam plate 62. Thus the anode assembly is reciprocated in first the left and then the fight direction in front of the fixture wheel 14. While a motor, cam and cam plate have been described for use in reciprocation of the anode assembly 18, it will be apparent to those of ordinary skill in the art that alternate mechanical drives could be employed to cause reciprocation of the anode assembly, all within the scope of the present invention.

Figure 7:
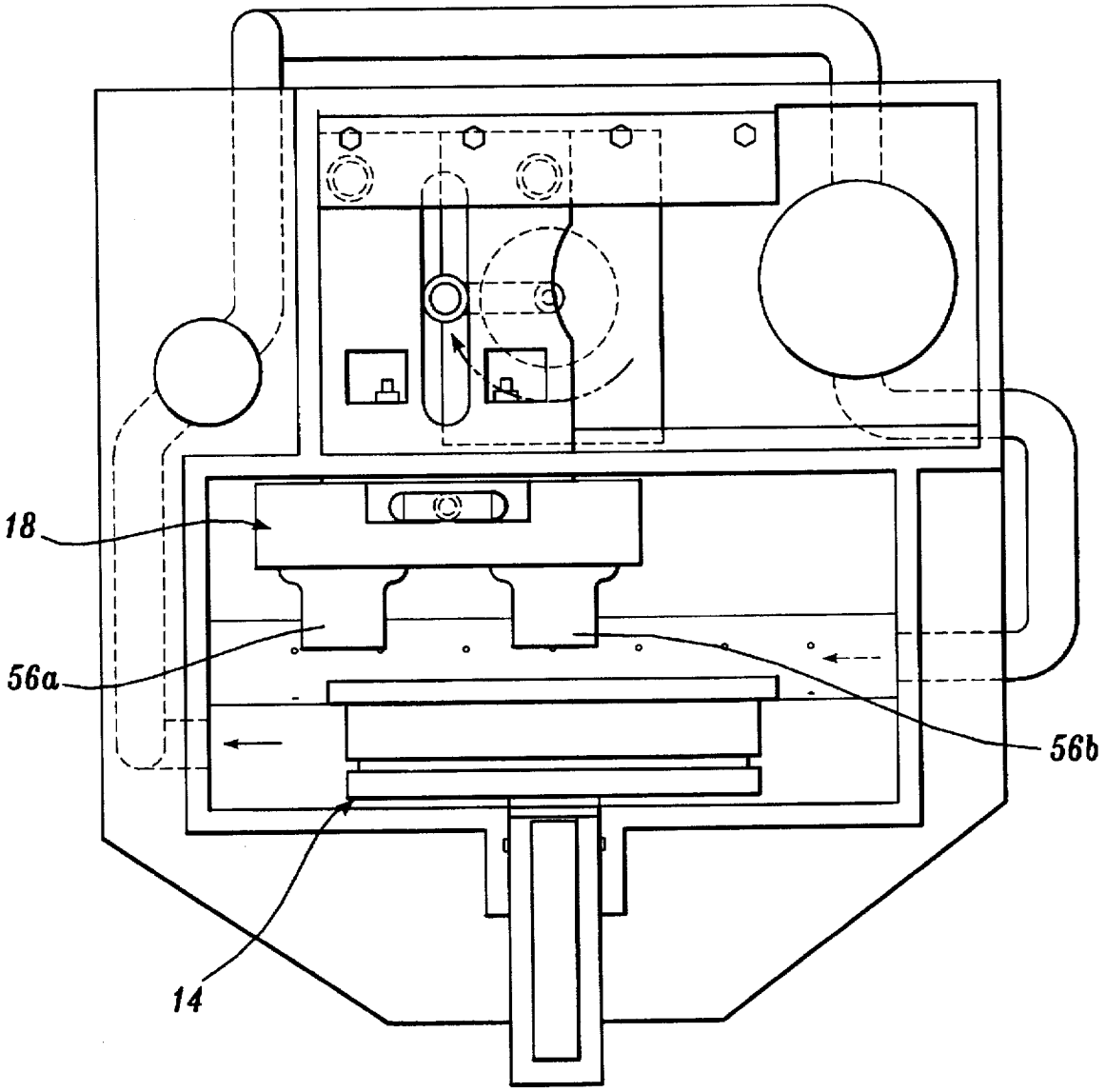
FIG. 7 provides a top plan view of the plating system of FIG. 1, with the anode assembly shown in a fully left reciprocated position.
Figure 8:
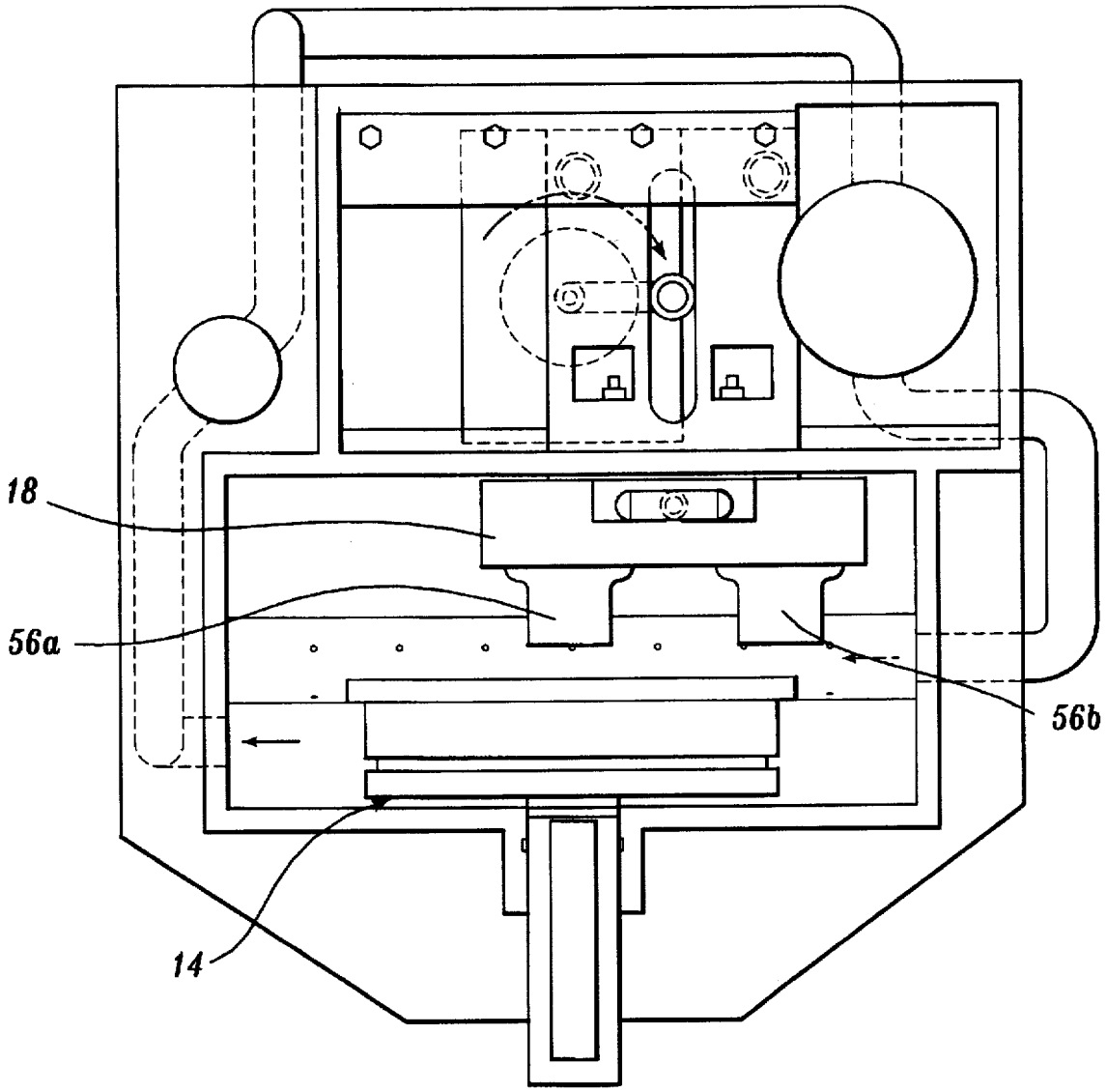
FIG. 8 illustrates a top plan view of the plating system of FIG. 1, with the anode assembly reciprocated to a fully right position.

The anode assembly 18 reciprocates between a leftmost position, shown in FIG. 7, and a rightmost position, shown in FIG. 8. In the leftmost position of FIG. 7, the right anode shield 56B is positioned centrally in front of the fixture wheel 14, and aligned on the axis of rotation 140. In the rightmost position, shown in FIG. 8, the left anode shield 56A is positioned centrally in front of the fixture wheel 14 and axially on the axis 140. Each anode 72A, 72B, thus reciprocates back and forth in front of the corresponding left and right sides of the fixture wheel 14. However, because the fixture wheel 14 is rotating about its axis 140 as the anode assembly 18 reciprocates, each anode 72A, 72B is exposed to the entirety of the semiconductor wafer carried by the fixture wheel 14.

As illustrated previously in FIG. 5, the diameter of the fixture wheel 14 is larger than the diameter of the carried semiconductor wafer 116. Each anode 72 reciprocates over a range which takes it beyond the perimeter of the received semiconductor wafer 116. The reciprocation of the anode assembly is thus designed to extend over a distance greater than the width of the semiconductor wafer. One suitable configuration entails plating a 6 inch wafer utilizing two anodes which are spaced 6 inches apart center to center on the anode assembly 18. The anode assembly is reciprocated a total left to right stroke of 4½ inches. As such, the anodes expose a total length of 10½ inches centered about the 6-inch wafer during reciprocation. These dimensions and lengths of travels are understood to be illustrative only, and may be adjusted as desired in accordance with the present invention.

Method of Operation

The speed of rotation of the fixture wheel 14, the speed of translation of the anode assembly 18, and the distance of stroke of the anode assembly 18 can be selectively adjusted and controlled to control the exposure of specific areas of the semiconductor wafer to the anode. The speed of operation of the fixture wheel drive motor 90 and anode reciprocation drive motor 142 are controlled by the controller 24, and may be selectively adjusted to achieve desired plating conditions. Thus, exposure can be controlled such that surface areas of the semiconductor wafer which are further from the supply of electrical current to the semiconductor wafer will receive a greater duration of anode exposure, to account for the lower available electric current density at those areas. For a single semiconductor wafer which is axially mounted on the fixture wheel 14, as has been described thus far, electrical current is typically supplied to the circular perimeter edge of the semiconductor wafer. Thus, an edge surface portion of the semiconductor wafer receives a higher available current density than does a center portion of the semiconductor wafer. The system 10 of the present invention can be operated such that the center surface portion of the semiconductor wafer receives greater anode exposure than does the edge surface portion. Thus, the duration of anode exposure for a given surface area segment is increased in proportion to the distance of that surface area segment from the point of electrical current supply, i.e., in inverse proportion to the available current density.

Figure 9A:
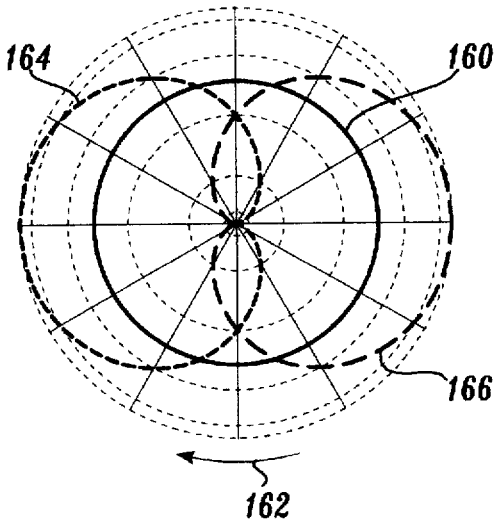
FIGS. 9A and 9B are schematic illustrations of the path that the center line (FIG. 9A) and focused width (FIG. 9B) of each anode traces relative to the semiconductor wafer during one reciprocal cycle of anode movement when the system is operated at a speed ratio of seven anode cycles per nine rotations of the fixture wheel.
Figure 9B:
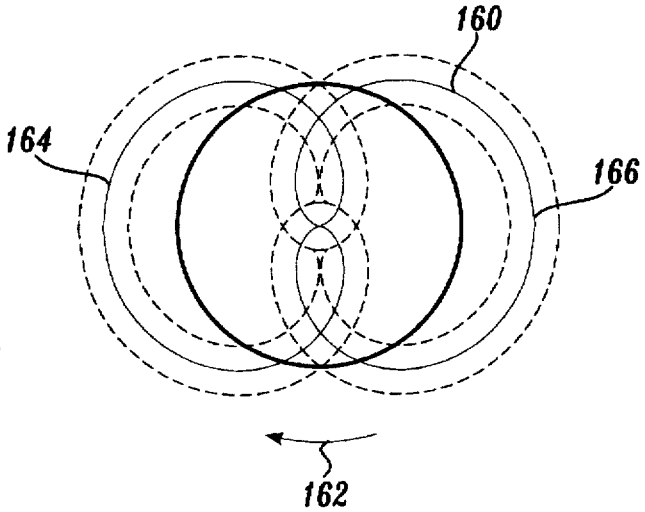

This method of operation is best understood with reference to FIGS. 9A–9B. FIG. 9A includes a radial plot superimposed over the top of a semiconductor wafer 160. The semiconductor wafer 160 is rotating about its axis in the direction indicated by arrow 162. The anode assembly 18 is at the same time reciprocated. The fine broken line trace 164 in FIG. 9A indicates the center line path of travel of the shielded left anode 72A. The larger broken line trace 166 indicates the center line path of travel of the shielded fight anode 72B. The traces 164 and 166 represent the path trace during one reciprocation cycle of the anode assembly 18, with one cycle being defined as a full stroke to the right followed by a full return stroke to the left. Each anode 72A, B traces an elliptical path which extends beyond the area of the semiconductor wafer 160. The trace of FIG. 9A was generated by computer modeling for a speed ratio of seven cycles of anode reciprocation per nine rotations of the semiconductor wafer 160. However, this ratio can be adjusted as may be desired for particular plating results. The tests which are set forth in experiments 1 and 2 below were conducted at a ratio of nine cycles of reciprocation per seven rotations per minute. It is believed that operation over a range as broad as nine cycles per five rotations to nine cycles per twelve rotations would be suitable for practice of the present invention, although alternate ratios may be adopted readily based on the disclosure contained herein, and are considered to be within the scope of the present invention.

FIG. 9B provides an illustration which is identical to FIG. 9A, except that the path traced by the entire focused center width of each focused anode is illustrated. Thus, it can be seen that the focused center path of each anode, as it passes over the wafer 160, exposes a finite width of the semiconductor wafer.

Figure 9C:
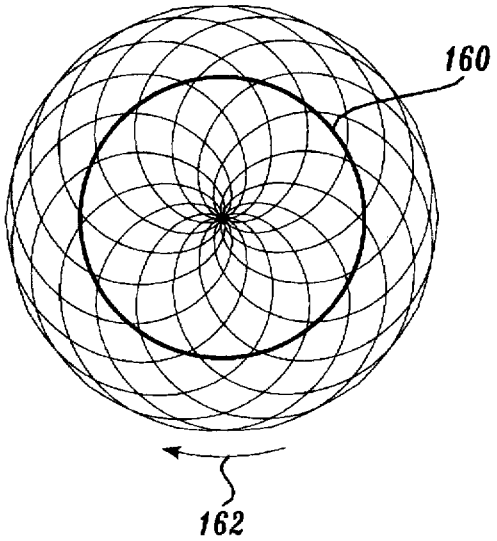
FIG. 9C is a schematic illustration of the cumulative anode center line path traced relative to a semiconductor wafer when the system is operated at a speed ratio of seven anode cycles per nine rotations of the fixture wheel.

FIG. 9C illustrates the exposure of a semiconductor wafer 160 to the anodes of the present system during operation at a speed ratio of seven cycles of reciprocation per nine rotations of the fixture wheel. The center line path of travel of both anodes is illustrated superimposed over the profile of the semiconductor wafer 160. Recalling that each centerline path in fact corresponds to a broader focused center width of exposure, it can be seen that the entire surface of the semiconductor wafer is exposed to the anodes. When operating at a speed of seven cycles of reciprocation per nine rotations per minute, it takes approximately one minute for the focused center current density path of the anode to cover the entire area of the wafer as illustrated. As plating is continued for a longer period of time, exposure of the entire wafer is repeated. As can be seen from the illustration of FIG. 9C, exposure of the semiconductor wafer 160 is greatest at the center of the semiconductor wafer 160 and then decreases radially towards the outer perimeter of the semiconductor wafer 160. This increased exposure at the center of the wafer thus adjusts for the decreased available current density. In particular, exposure of the centermost portion of the wafer to the anode is approximately ten times greater than exposure of the edge portions of the wafer for the noted conditions of operation.

Figure 9D:
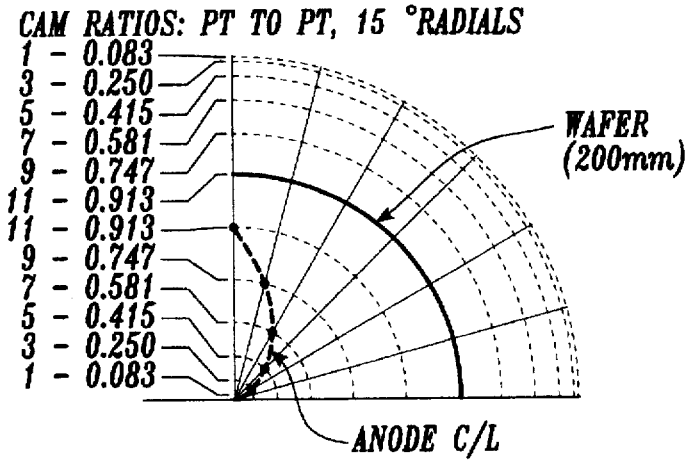
FIG. 9D provides a schematic illustration of the distance of radial movement of the anode center line relative to the semiconductor wafer for each 15° rotation of the wafer when the system is operated at a speed ratio of seven anode cycles per nine wafer rotations.

This effect is further illustrated with reference to FIGS. 9A, 9D and 9E. The radial plot superimposed over the semiconductor wafer 160 in FIG. 9A is broken into 15° radial sectors. FIG. 9D illustrates point to point cam ratios obtained as an anode center line path moves in an arc outwardly from the center of the semiconductor wafer during reciprocation. The radial distances traveled by the center line path of the anode as it crosses each 15° radial sector are set forth in FIG. 9D. This determination was also made based on operation at a ratio of seven cycles of reciprocation per nine rotations of the fixture wheel, for a 200 mm wafer. The radial distance of travel ranges from 0.083 inch at the center of the wafer to 0.913 inch near the edge portion of the wafer.

Figure 9E:
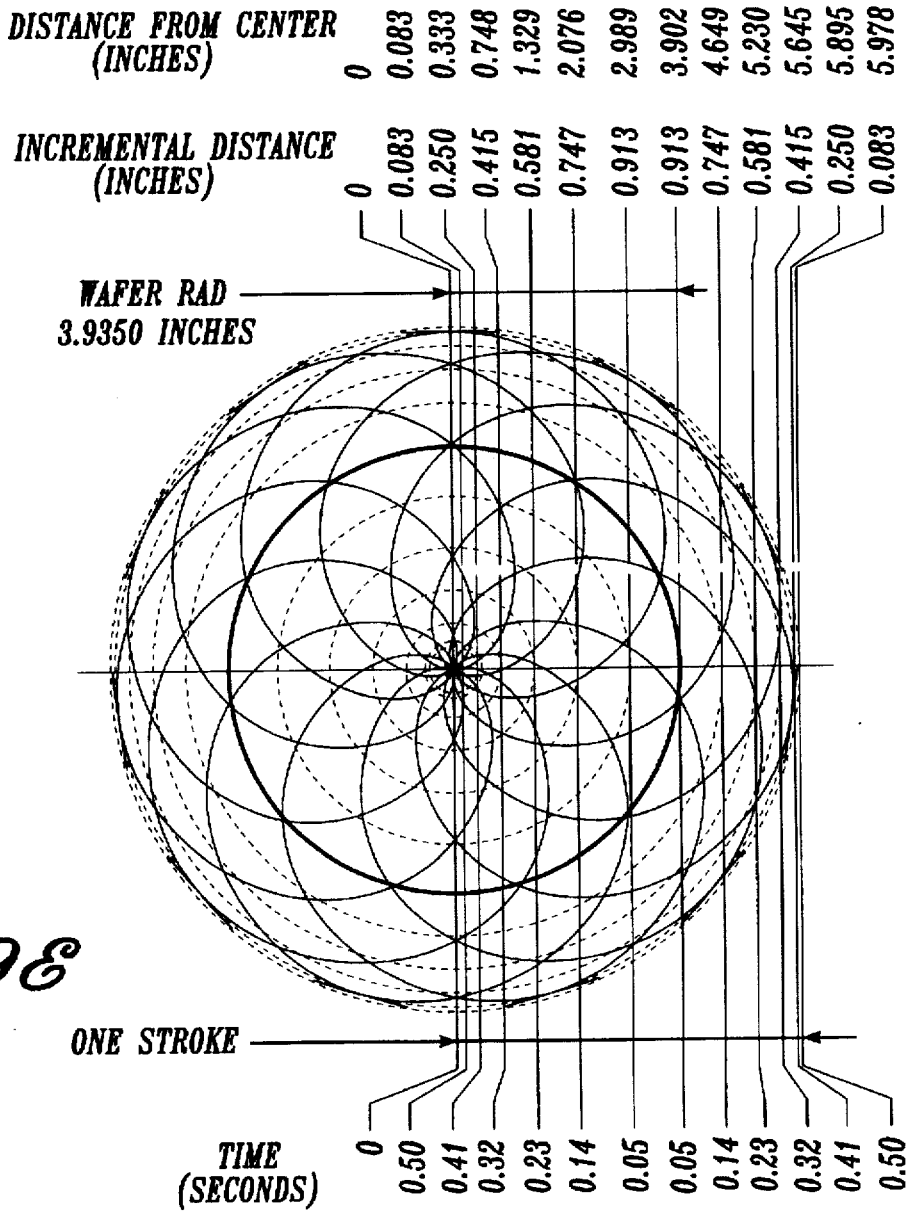
FIG. 9E provides a schematic illustration of the 15° radial incremental and cumulative distances traveled by the anode center relative to the center of the wafer and corresponding time intervals for each radial increment.

FIG. 9E illustrates the same effect over the entire circumference of the wafer, and also provides exposure times for annular segments of the wafer. Again, it can be seen that exposure to the anodes is greatest at the center portion of the wafer relative to the perimeter edge portions of the wafer.

The present invention provides for a deviation in plating thickness of less than or equal to ±5% for 5 to 8 inch diameter wafers, and of less than or equal to ±3% or better for 3 to 4 inch diameter wafers.

EXAMPLE I

Planting Thickness Relative To Location On Wafer

The system of the present invention as described above was operated for plating of a semiconductor wafer with a nominal 60/40 (elemental wt. %) tin/lead eutectic composition in an industry standard electrolytic solution. The system was operated at a speed of nine anode cycles per seven revolutions per minute of the fixture wheel. Each anode cycle is considered to be a complete left and right return stroke. The system was operated for 33 minutes.

Figure 10:
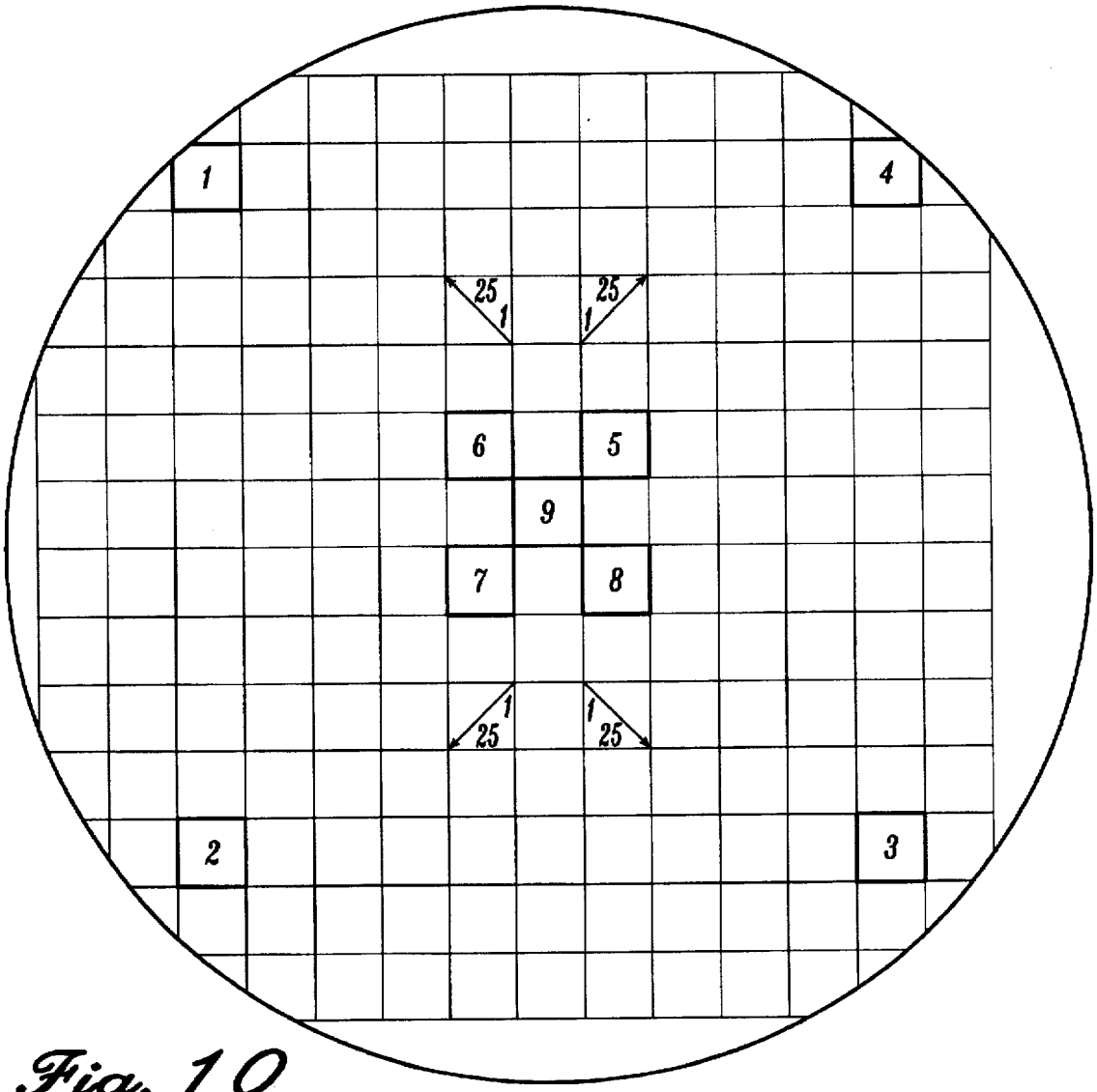
FIG. 10 is a schematic illustration of circuits plated on a semiconductor wafer, with locations of circuits tested to develop the data of Tables I and II herein being indicated numerically.

Nine dies (circuits) were selected from the semiconductor wafer for testing as indicated in FIG. 10. Die 9 was located at the center of the wafer, furthest from the outer perimeter source of electrical current. Dies 5 through 8 surround the center die, while dies 1 through 4 are located at the extreme radial edges of the wafer. For each of dies 1 through 8, bump plating thicknesses were measured in microns in the radial direction, with a first measurement being taken at the corner of the die closest to the center of the wafer, and then proceeding sequentially and diagonally across the die. The 25th and last measurement for each of dies 1 through 8 was taken at the radially outermost corner of the die. For die 9, measurements were taken from the upper left corner towards the lower right corner of the die. The bump height determined by 25 measurements for each die are set forth in Table I below.

The thicknesses for each die were highly uniform, with no greater than a 1.6 micron deviation for a nominal 45 micron plating thickness, i.e., deviation of less than 3½% for each die. The deviation from die to die was also very minor, with the exception of die 2, for which it is assumed there was a photoresist defect or other defect not associated with the plating method. Excluding die 2, the maximum deviation from die to die for dies 1 and 3 through 9 was 1.1 micron, or less than 2½%.

TABLE I

| Location | DIE 1 | DIE 2 | DIE 3 | DIE 4 | DIE 5 | DIE 6 | DIE 7 | DIE 8 | DIE 9 |
|---|---|---|---|---|---|---|---|---|---|
| | 12/31 Tin-Lead Bump Plating Thickness (Microns) | | | | | | | | |
| 1 | 0 | 43 | 48 | 46 | 45 | 46 | 45 | 47 | 46 |
| 2 | 0 | 42 | 47 | 45 | 45 | 46 | 47 | 46 | 46 |
| 3 | 0 | 42 | 47 | 45 | 44 | 45 | 47 | 46 | 46 |
| 4 | 46 | 42 | 46 | 46 | 45 | 46 | 46 | 46 | 46 |
| 5 | 45 | 43 | 47 | 45 | 44 | 45 | 46 | 45 | 45 |
| 6 | 45 | 42 | 47 | 47 | 44 | 44 | 47 | 45 | 45 |
| 7 | 46 | 43 | 46 | 46 | 44 | 45 | 46 | 45 | 46 |
| 8 | 44 | 40 | 46 | 45 | 45 | 46 | 46 | 44 | 46 |
| 9 | 45 | 43 | 45 | 46 | 45 | 44 | 45 | 44 | 45 |
| 10 | 45 | 41 | 47 | 44 | 44 | 45 | 46 | 44 | 46 |
| 11 | 44 | 40 | 46 | 45 | 44 | 45 | 46 | 45 | 46 |
| 12 | 45 | 41 | 46 | 45 | 45 | 46 | 46 | 44 | 46 |
| 13 | 46 | 41 | 46 | 45 | 44 | 45 | 46 | 46 | 46 |
| 14 | 45 | 40 | 46 | 46 | 45 | 46 | 45 | 45 | 45 |
| 15 | 44 | 40 | 45 | 45 | 46 | 47 | 46 | 45 | 45 |
| 16 | 45 | 45 | 45 | 45 | 45 | 46 | 45 | 45 | 46 |
| 17 | 45 | 41 | 45 | 46 | 45 | 46 | 45 | 44 | 46 |
| 18 | 46 | 41 | 45 | 46 | 44 | 46 | 46 | 45 | 47 |
| 19 | 45 | 40 | 45 | 47 | 44 | 44 | 45 | 45 | 46 |
| 20 | 47 | 40 | 46 | 48 | 45 | 44 | 44 | 45 | 46 |
| 21 | 46 | 39 | 44 | 47 | 44 | 45 | 46 | 45 | 44 |
| 22 | 46 | 39 | 45 | 48 | 44 | 45 | 46 | 46 | 46 |
| 23 | 46 | 40 | 45 | 46 | 45 | 46 | 46 | 49 | 45 |
| 24 | 47 | 42 | 45 | 46 | 46 | 47 | 46 | 49 | 46 |
| 25 | 46 | 42 | 46 | 46 | 47 | 48 | 47 | 50 | 46 |
| Average | 45.4 | 41.3 | 45.8 | 45.8 | 44.7 | 45.5 | 45.8 | 45.6 | 45.7 |
| StDev | 0.9 | 1.5 | 0.9 | 1.0 | 0.8 | 1.0 | 0.7 | 1.6 | 0.6 |

EXAMPLE II

Planting Composition Relative To Location On Wafer

A semiconductor wafer was plated with nominal 60/40 (weight %) tin/lead using the same procedure as set forth in Example I above. Plating bumps were analyzed in each of nine die (circuit) locations, as indicated in FIG. 10. Two bumps were analyzed in each die. The elemental composition of tin and lead in each measured die and bump is set forth in Table II below. The plating composition was extremely uniform across the width of the wafer. The outermost dies 1 through 4 were determined to have an average composition of 60.145% tin and 39.855% lead. The innermost dies 5 through 9 had an average composition of 59.6% tin and 40.4% lead.

TABLE II

| Elemental Plating Compositions (Weight %) | | |
|---|---|---|
| DIE/BUMP | TIN | LEAD |
| 1-1 | 58.84 | 41.16 |
| 1-2 | 57.21 | 42.79 |
| 2-1 | 59.95 | 40.05 |
| 2-2 | 60.32 | 39.68 |
| 3-1 | 62.39 | 37.61 |
| 3-2 | 62.00 | 38.00 |
| 4-1 | 60.75 | 39.25 |
| 4-2 | 59.70 | 40.30 |
| 5-1 | 57.08 | 42.92 |
| 5-2 | 55.87 | 44.13 |

TABLE II-continued

| Elemental Plating Compositions (Weight %) | | |
|---|---|---|
| DIE/BUMP | TIN | LEAD |
| 6-1 | 58.47 | 41.53 |
| 6-2 | 58.55 | 41.45 |
| 7-1 | 61.52 | 38.48 |
| 7-2 | 61.08 | 38.92 |
| 8-1 | 61.54 | 38.46 |
| 8-2 | 60.77 | 39.23 |
| 9-1 | 59.98 | 40.02 |
| 9-2 | 61.14 | 38.86 |

While a preferred embodiment of the plating system 10 has been illustrated above, it should be apparent that various alterations are possible within the scope of the present invention. Thus, while rotation of the semiconductor wafer and reciprocation of the anode has been disclosed, it should be apparent that a similar effect could be obtained by rotating the anode assembly and reciprocating the semiconductor wafer.

Figure 11:
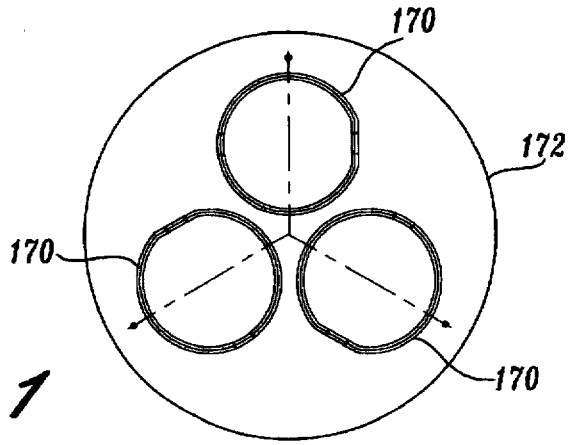
FIG. 11 is a schematic illustration of an alternative embodiment of the present invention wherein three semiconductor wafers are mounted on the rotating fixture wheel.

As a further example, while the mounting of a single semiconductor wafer centrally on the fixture wheel 14 has been described and illustrated, it should be apparent that the invention could be adapted to mount multiple semiconductor wafers of smaller diameter on a single wheel. Thus, FIG. 11 illustrates a method of mounting three semiconductor wafers 170 on a fixture wheel 172. These wafers are oriented at even radial intervals. A retaining plate including three apertures corresponding to the semiconductor wafers would be utilized to retain the wafers on the fixture wheel and to provide electrical current to the edges of the wafer. Fixture wheel rotation and anode reciprocation would be controlled to account for differences in current density, similar to the manner previously described.

While a single anode assembly including two anodes has been illustrated, it should be apparent that a single anode, or more than two anodes, could alternately be employed. Further, while it has been illustrated that both anodes travel in tandem on a common assembly, it should be apparent that individual anodes could be moved independently of each other to enable greater flexibility in controlling anode exposure.

Exposure of anodes to particular surface area portions of a semiconductor wafer can be further varied by changing the length of stroke of the anode assembly travel at set intervals during plating. Alternately, the speed of anode travel during each stroke may be varied at different points of the stroke to further control anode exposure. This may be accomplished, for example, by changing the cam path to delay or speed up travel at certain points.

The fixture wheels and anode assembly disclosed in the present invention are also well suited for utilization in larger systems where multiple fixture wheels and multiple corresponding anode assemblies are employed.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A plating system for plating a substrate in an electrolyte, comprising:

a tank for containing the electrolyte;

a fixture wheel, mounted in the tank to rotate about a first axis, the fixture wheel being capable of receiving the substrate and supplying electrical current to the substrate;

a first motor for rotating the fixture wheel about the first axis;

an anode assembly, mounted in the tank spaced from and facing the fixture wheel, capable of receiving an anode and supplying electrical current to the anode; and a second motor for reciprocating the anode assembly transversely relative to the rotating fixture wheel.

2. The plating system of claim 1, further comprising an annular anode shield carried on the anode assembly to focus exposure of the anode relative to the fixture wheel.

3. The plating system of claim 1, wherein the anode assembly comprising first and second spaced-apart anodes.

4. The plating system of claim 3, wherein the first and second anodes are disposed in alignment and reciprocated along a line oriented perpendicular to the first axis.

5. The plating system of claim 3, wherein the first and second anodes are arranged for mounting on the anode assembly to reciprocate in tandem.

6. The plating system of claim 1, further comprising means for reciprocate the anode assembly along a line oriented perpendicular to the first axis.

7. The plating system of claim 6, wherein the means for reciprocating the anode assembly reciprocates the anode assembly along a line oriented perpendicular to and at an elevation that is the same as an elevation defined by the first axis.

8. The plating system of claim 1, further comprising means for reciprocating the anode assembly along a line oriented perpendicular to the first axis.

9. The plating system of claim 1, wherein the means for reciprocating the anode assembly reciprocates anode assembly along a path of movement which is greater in length than the width of a substrate backing portion of the fixture wheel.

10. The plating system of claim 1, further comprising control means for controlling at least one of the speed of rotation of the fixture wheel and the speed of reciprocation of the anode assembly.

11. The plating system of claim 10, wherein the control means comprises means for controlling both the speed of rotation of the fixture wheel and the speed of reciprocation of the anode assembly.

12. The plating system of claim 1, wherein the fixture wheel has a substrate backing portion including an edge surface portion and an inner surface portion, further comprising means for supplying electrical current to the edge surface portion.

13. The plating system of claim 12, further comprising means for controlling the speed of rotation of the fixture wheel and/or the speed of reciprocation of the anode to increase exposure of the anode to the inner surface portion of the fixture wheel relative to the edge surface portion of the fixture wheel.

14. The plating system of claim 13, the fixture wheel adapted to supplies electrical current to the edge surface portion of the fixture wheel and the speed of rotation and/or speed of reciprocation of the anode assembly are controlled by the means for controlling to increase exposure of the anode to the inner surface portion of the fixture wheel relative to the edge surface portion of the fixture wheel.

15. A plating system for plating a substrate in an electrolyte, comprising:

a tank;

a substrate fixture suspended in the tank capable of receiving the substrate, the substrate fixture having a perimeter surface portion and an inner surface portion;

an electrical contact assembly carried on the substrate fixture for supplying electrical current to the perimeter surface portion of the substrate fixture;

a first motor coupled to the substrate fixture for imparting rotary or translational movement to the substrate fixture during plating;

an anode suspended in the tank; and a second motor coupled to the anode for imparting rotary or translational movement to the anode during plating;

wherein, the first and second motors are operable to increase exposure of the anode to the inner surface portion of the substrate fixture relative to the perimeter surface portion of the substrate fixture.

16. A plating system for plating a substrate in an electrolytic bath, comprising:

a substrate fixture for mounting and supplying electrical current to the substrate;

an anode assembly for mounting and supplying electrical current to an anode;

rotary means for rotating one of the substrate fixture and anode assembly about a first axis;

translation means for translating the other of the substrate fixture and anode assembly transversely to the axis of rotation; and control means for controlling the speed of rotation relative to the speed of translation to increase uniformity of plating on the substrate.

17. A plating system for plating a substrate in an electrolytic bath, comprising:

a substrate fixture for mounting and supplying electrical current to the substrate;

means for rotating the substrate fixture about a first axis;

an anode assembly for mounting and supplying electrical current to an anode;

means for moving the anode assembly transversely relative to the rotating substrate fixture; and control means for controlling the speed of movement of the anode assembly relative to the speed of rotation of the substrate fixture to increase uniformity of plating on the substrate.

18. A method for electrolytic plating of a substrate in an electrolytic bath, comprising the steps of:

mounting the substrate on a substrate fixture suspended within the electrolytic bath, with the substrate being oriented in spaced disposition relative to an anode also suspended within the electrolytic bath;

rotating one of the substrate fixture and anode about a first axis of rotation; and translating the other of the substrate fixture and anode transversely relative to the axis of rotation during plating.

19. The method of claim 18, further comprising shielding the anode to focus exposure of the anode on the mounted substrate.

20. The method of claim 18, further comprising controlling the speed of movement of the substrate fixture and anode to increase the uniformity of plating deposited on the substrate.

21. The method of claim 20, further comprising:

supplying electrical current to an edge surface portion of a mounted substrate; and controlling movement of the anode relative to movement of the substrate fixture to increase exposure of the anode to an inner surface portion of the substrate relative to the edge surface portion of the substrate.

22. The method of claim 18, wherein the movement of the anode comprises movement of an anode assembly carrying first and second anodes.

* * * * *

UNITED STATES PATENT AND TRADEMARK OFFICE

CERTIFICATE OF CORRECTION

PATENT NO. : 5,670,034

DATED : September 23, 1997

INVENTOR(S) : K.J. Lowery

It is certified that error appears in the above-identified patent and that said Letters Patent is hereby corrected as shown below:

On the title page, under item [56]

| | | |
|---|---|---|
| Pg. 1, col. 2 | Attorney, Agent or Firm | "O'Conner" should read --O'Connor-- |

| Column | Line | |
|---|---|---|
| 14 | 24 | "wheel" should read --wheel is-- |
| (Claim 14, line 1) | | |
| 14 | 25 | "to supplies" should read --to supply-- |
| (Claim 14, line 2) | | |

Signed and Sealed this

Third Day of March, 1998

*Attest:*

*Attesting Officer*

BRUCE LEHMAN

*Commissioner of Patents and Trademarks*